US010151996B2

(12) United States Patent
Kanazawa

(10) Patent No.: US 10,151,996 B2
(45) Date of Patent: Dec. 11, 2018

(54) IMAGE FORMING APPARATUS

(71) Applicant: CANON KABUSHIKI KAISHA, Tokyo (JP)

(72) Inventor: Hidenori Kanazawa, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/625,954

(22) Filed: Jun. 16, 2017

(65) Prior Publication Data

US 2018/0004116 A1 Jan. 4, 2018

(30) Foreign Application Priority Data

Jun. 30, 2016 (JP) ..... 2016-131039

(51) Int. Cl.

| | |
|---|---|
| ***G03G 15/041*** | (2006.01) |
| ***G03G 15/043*** | (2006.01) |
| ***G03G 15/045*** | (2006.01) |
| ***G03G 15/047*** | (2006.01) |

(52) U.S. Cl.

CPC ..... *G03G 15/043* (2013.01); *G03G 15/045* (2013.01); *G03G 15/047* (2013.01); *G03G 15/0415* (2013.01)

(58) Field of Classification Search

CPC ..... G03G 15/0415; G03G 15/043; G03G 15/045; G03G 15/047

See application file for complete search history.

(56) References Cited

U.S. PATENT DOCUMENTS

| | | | | |
|---|---|---|---|---|
| 6,310,681 | B1 | 10/2001 | Taniwaki | 355/55 |
| 9,319,553 | B2 | 4/2016 | Kawana et al. | H04N 1/02885 |
| 9,360,791 | B2 | 6/2016 | Oyama | G03G 15/043 |
| 9,658,562 | B2 | 5/2017 | Watanabe et al. | G03G 15/556 |
| 2009/0196639 | A1* | 8/2009 | Ozeki | G03G 15/081 399/55 |
| 2016/0370727 | A1 | 12/2016 | Nakajima et al. | G03G 21/14 |

FOREIGN PATENT DOCUMENTS

| | | | |
|---|---|---|---|
| JP | 08020127 | A * | 1/1996 |
| JP | H08-020127 | | 1/1996 |
| JP | H09-169135 | | 6/1997 |
| JP | H11-198435 | | 7/1999 |
| JP | 2016-000511 | | 1/2016 |

OTHER PUBLICATIONS

U.S. Appl. No. 15/489,450, filed Apr. 17, 2017.
U.S. Appl. No. 15/616,772, filed Jun. 7, 2017.

* cited by examiner

*Primary Examiner* — Joseph S Wong

(74) *Attorney, Agent, or Firm* — Fitzpatrick, Cella, Harper & Scinto

(57) ABSTRACT

In an image forming apparatus, a correction control unit of an image clock control unit controls the frequency of an image clock, so that the partial magnification of each position in an image region in which an image is formed is corrected in a main scanning direction that is a direction in which a laser beam scans a scanning region of one line. When controlling the frequency of the image clock, the correction control unit makes the change rate (the slope) that is a change amount of the image clock per unit time, be smaller in a non-image region being a region other than the image region, than the change rate in the image region.

17 Claims, 13 Drawing Sheets

IMAGE FORMING APPARATUS

BACKGROUND OF THE INVENTION

Field of the Invention

The present invention relates to an image forming apparatus.

Description of the Related Art

An optical scanning apparatus applied to an image forming apparatus is commonly provided with an imaging lens (a scanning lens) having an fθ characteristic such that a laser beam (a light beam) scans the surface of a photosensitive drum at a constant speed. In recent years, to miniaturize an image forming apparatus, an approach of either using a scanning lens that does not having a desired fθ characteristic, or omitting a scanning lens that has an fθ characteristic and instead electrically correcting partial magnification in the main scanning direction is proposed (refer to Japanese Patent Laid-Open No. 2016-000511). Note that partial magnification indicates a magnification for each position in the main scanning direction.

Correction of partial magnification can be performed by controlling a frequency of an image clock for controlling timings at which a laser light source emits light. Control of the frequency of the image clock may be realized by a PLL (frequency synthesizer) circuit or the like that can change (shift) the frequency of an inputted reference clock in accordance with a setting signal. In a case of using a PLL circuit, when control for causing the frequency of an image clock to change by a large change rate (a change amount per unit time) is performed, there is the possibility of an error occurring in control of the frequency of an output signal due to a response property of the PLL circuit. That is, there is the possibility of a delay occurring for the frequency of the image clock reaching the frequency necessary for the partial magnification correction. Such an error may be a reason for a reduction of the accuracy of a partial magnification correction.

SUMMARY OF THE INVENTION

The present invention was conceived in view of the above described issues. The present invention provides a technique for preventing, in an image forming apparatus, a reduction of accuracy of a partial magnification correction due to an error arising in frequency control of an image clock.

According to one aspect of the present invention, there is provided an image forming apparatus, comprising: a light source that emits a light beam for exposing a photosensitive member; a deflection unit that deflects the light beam emitted from the light source such that the light beam scans the photosensitive member; a generation unit that generates an image clock for controlling timings at which the light source emits light; and a control unit that controls a frequency of the image clock generated by the generation unit according to each position in an image region in which an image is formed in a main scanning direction that is a direction in which the light beam scans a scanning region of one line, wherein the control unit controls the frequency of the image clock in a non-image region that is a region other than the image region, and wherein a change rate of the frequency of the image clock per unit time in the non-image region is smaller than a change rate of the frequency of the image clock per unit time in the image region.

According to another aspect of the present invention, there is provided an image forming apparatus, comprising: a light source that emits a light beam for exposing a photosensitive member; a deflection unit that deflects the light beam emitted from the light source such that the light beam scans the photosensitive member; a generation unit that generates an image clock for controlling timings at which the light source emits light; and a control unit that controls a frequency of the image clock generated by the generation unit according to each position in an image region in which an image is formed in a main scanning direction that is a direction in which the light beam scans a scanning region of one line, wherein the control unit decides the frequency of the image clock in a non-image region being a region other than the image region, in accordance with the frequency of the image clock in the image region.

By virtue of the present invention, it is possible to prevent, in an image forming apparatus, a reduction of accuracy of a partial magnification correction due to an error arising in frequency control of an image clock.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

First Embodiment

<Image Forming Apparatus 1>

Figure 1:
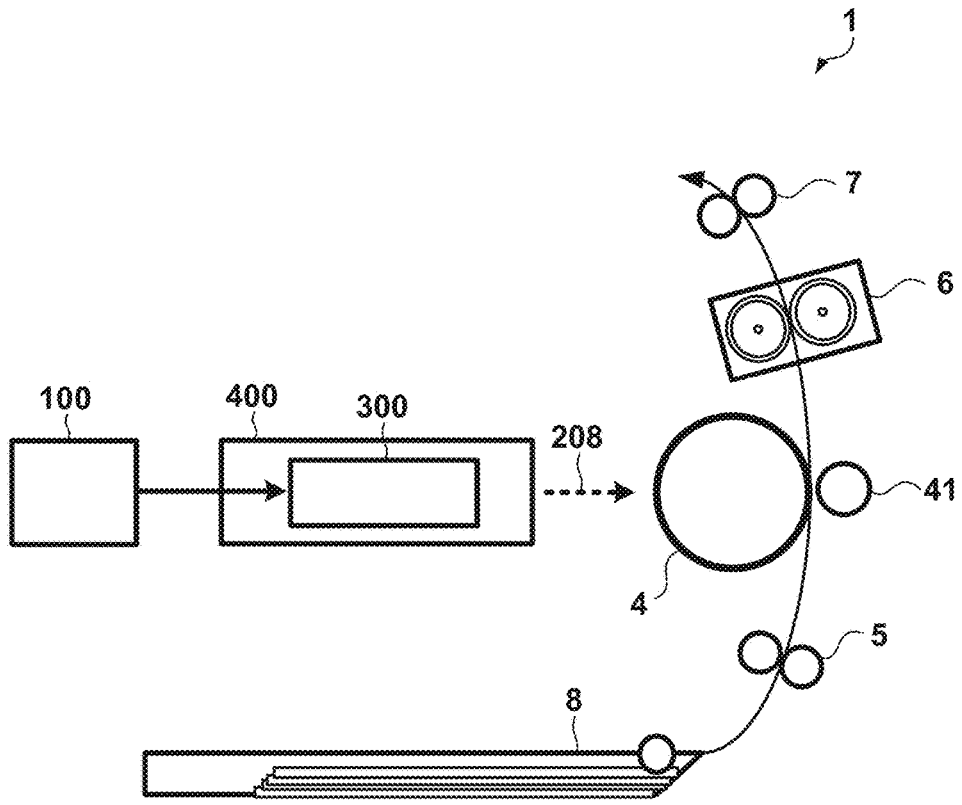
FIG. 1 illustrates a schematic example of a configuration of an image forming apparatus.

FIG. 1 illustrates a schematic example of a configuration of an image forming apparatus 1. A laser driving unit 300 of an optical scanning apparatus 400 causes a laser beam (light beam) 208 to be emitted from a light source 401 (FIG. 2A) based on an image signal (image data) and a control signal that are output from a control unit 100. This laser beam 208 scans and exposes a photosensitive drum (photosensitive member) 4 that has charged by a charging unit (not shown), to form a latent image (electrostatic latent image) on the surface of the photosensitive drum 4. A developing unit (not shown) develops the latent image formed on the surface of the photosensitive drum 4 with toner to form a toner image. In addition, a recording medium (sheet) fed from a sheet feeding unit 8 is conveyed by a roller 5 to a nip portion between the photosensitive drum 4 and a transfer roller 41. The transfer roller 41 transfers the toner image formed on the photosensitive drum 4 onto this recording medium. Thereafter, the recording medium conveyed to a fixing unit 6. The fixing unit 6 applies heat and pressure to the recording medium to fix the toner image on the recording medium. The recording medium on which the toner image is fixed is discharged outside the image forming apparatus 1 by a sheet discharge roller 7.

<Optical Scanning Apparatus 400>

Figure 2A:
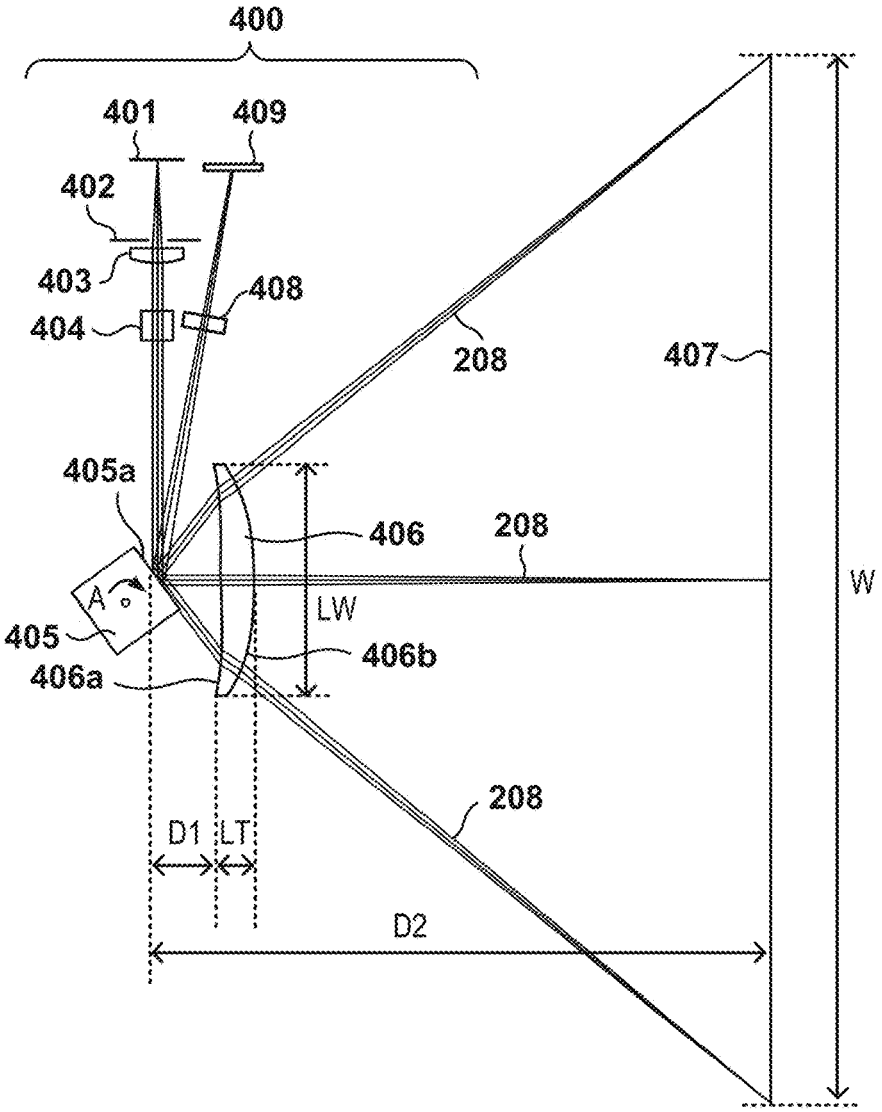
FIGS. 2A and 2B are cross-sectional views that illustrate an example of a configuration of an optical scanning apparatus.
Figure 2B:
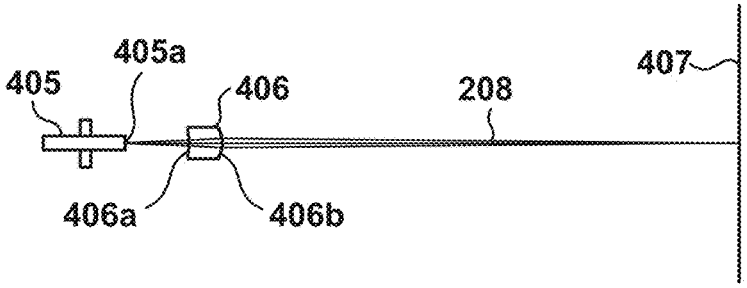

FIGS. 2A and 2B illustrate a configuration of the optical scanning apparatus 400: FIG. 2A is a cross-sectional view in a main scanning direction, and FIG. 2B is a cross-sectional view in a sub scanning direction. The optical scanning apparatus 400 is provided with a light source 401, an aperture stop 402, a coupling lens 403, an anamorphic lens 404, a deflector 405, and an imaging lens 406. Optical members of the optical scanning apparatus 400 may be contained in one housing (optical unit).

The laser beam (light beam) 208 emitted by the light source 401 is incident on the coupling lens 403 after being shaped into an elliptical shape by the aperture stop 402. The laser beam 208 having passed through the coupling lens 403 is converted into approximately parallel light, and is incident on the anamorphic lens 404. Note that the approximately parallel light includes weak converging light and weak diverging light. The anamorphic lens 404 has positive refractive power in a main scanning cross-section (a cross-section in the main scanning direction), and converts the incident light beam to converging light in the main scanning cross-section. In addition, the anamorphic lens 404 focuses the light beam near to a deflection surface (reflective surface) 405*a* of the deflector 405 in a sub scanning cross-section (cross-section in the sub scanning direction), and forms a line image that is long in the main scanning direction.

The light beam having passed through the anamorphic lens 404 is reflected by the deflection surface 405*a* of the deflector (a polygon mirror) 405. The laser beam 208 after being reflected by the deflection surface 405*a* transmits the imaging lens 406 (an image forming optical element), and forms an image on the surface of the photosensitive drum 4 so as to form a predetermined spot-shaped image (hereinafter referred to as a "spot"). By causing the deflector 405 to rotate by a driving unit (not shown) at a constant angular velocity in the direction of an arrow A, the spot on a scanned surface 407 of the photosensitive drum 4 moves in the main scanning direction. Accordingly, an electrostatic latent image is formed on the scanned surface 407. Note that the main scanning direction is a direction that is parallel to the surface of the photosensitive drum 4, and orthogonal to a moving direction of the surface of the photosensitive drum 4. In addition, the sub scanning direction is the moving direction of the surface of the photosensitive drum 4 (a direction orthogonal to the main scanning direction).

A beam detection (BD) sensor 409 and a BD lens 408 are an optical system for synchronization that determine a timing at which the electrostatic latent image is written on the scanned surface 407. The BD sensor 409 and the BD lens 408 are arranged at positions that are apart from the scanned surface 407 and are on a scanning path of the laser beam 208 after being deflected by the deflector 405. When the laser beam 208 that moves in the main scanning direction on the scanning path after being deflected by the deflector 405 passes through the BD lens 408, the laser beam 208 is incident on and detected by the BD sensor 409 which includes a photodiode. The control unit 100 controls a timing at which an electrostatic latent image is written on the scanned surface 407 (the photosensitive drum 4), based on the timing when the laser beam 208 is detected by the BD sensor 409. In this way, in the present embodiment, the light source 401 is an example of a light source that emits the laser beam 208 (light beam) for exposing the photosensitive drum 4. In addition, the deflector 405 is an example of a deflection unit that deflects the laser beam 208 (light beam) emitted from the light source 401 such that the light beam scans the photosensitive drum 4.

The light source 401 of the present embodiment is a semiconductor laser chip provided with one light-emitting unit, but may be provided with a plurality of light-emitting units that can be controlled to emit light independently. Even if the light source 401 is provided with a plurality of light-emitting units, a plurality of laser beams emitted from the plurality of light-emitting units will each pass through the coupling lens 403, the anamorphic lens 404, the deflector 405, and the imaging lens 406 to reach the scanned surface 407. The plurality of laser beams will form images at respectively different positions in the sub scanning direction on the scanned surface 407. By this, a spot corresponding to each laser beam is formed on the scanned surface 407.

<Partial Magnification of Image Forming Lens 406>

As illustrated by FIGS. 2A and 2B, the imaging lens 406 has two optical surfaces (lens surfaces): an incoming surface (a first surface) 406*a* and an outgoing surface (a second surface) 406*b*. The imaging lens 406 has a configuration such that, in the main scanning cross-section, the laser beam 208 after being deflected by the deflection surface 405*a* scans the scanned surface 407 in accordance with a desired scanning characteristic, and the spot of the laser beam 208 has a desired shape on the scanned surface 407. In addition, the imaging lens 406 has a configuration such that, in the sub scanning cross-section, a vicinity of the deflection surface 405*a* and a vicinity of the scanned surface 407 are in a conjugate relationship. By this, the imaging lens 406 has a configuration for compensating for plane tilt (reducing scanning position misalignment in the sub scanning direction on the scanned surface 407 when the deflection surface 405*a* has inclined).

Note that the imaging lens 406 may be configured by a plastic molded lens formed by injection molding, or may be formed as a glass molded lens. For a molded lens, formation of an aspherical shape is easy, and it is suitable to mass production. Accordingly, by employing a molded lens as the imaging lens 406, it is possible to improve ability to be mass produced and optical characteristics thereof.

In the optical scanning apparatus 400 of the present embodiment, an imaging lens 406 that does not have a desired fθ characteristic is used. This means that, when the deflector 405 is rotating with uniform angular velocity, a spot according to the laser beam 208 that passes through the imaging lens 406 after being deflected by the deflector 405 does not move at a constant velocity on the scanned surface 407. By using an imaging lens 406 that does not have a desired fθ characteristic in this way, it is possible to arrange the imaging lens 406 close to the deflector 405 (shorten a distance D1). Furthermore, it is possible to make the size of the imaging lens 406 in the main scanning direction (a width LW) and the size in an optical axis direction (a thickness LT) smaller than in a case of using an imaging lens that has a desired fθ characteristic. Miniaturization of (the housing of) the optical scanning apparatus 400 is thus realized. In addition, when using a lens that has a desired fθ characteristic, there are cases where there is sharp change in the shape on the incoming surface and the outgoing surface of the lens when seen in accordance with the main scanning cross-section. If there are such restrictions on the shape, there is the possibility that good imaging performance cannot be achieved. In contrast to this, with an imaging lens 406 that does not have the desired fθ characteristic, there is the advantage of being able to achieve good imaging performance because there is less sharp change in the shape of the incoming surface and the outgoing surface of the imaging lens 406 seen in accordance with the main scanning cross-section. Note that, in the present embodiment, explanation is given of an example in which the imaging lens 406 does not have the fθ characteristic. However, the imaging lens 406 is not necessarily limited to something that does not have the fθ characteristic. Configuration may be taken to cause the imaging lens 406 or another lens (not shown) to have the fθ characteristic in a portion of the main scanning direction for example, and compensate for the fθ characteristic by performing a partial magnification correction electrically for other portions.

Figure 3:
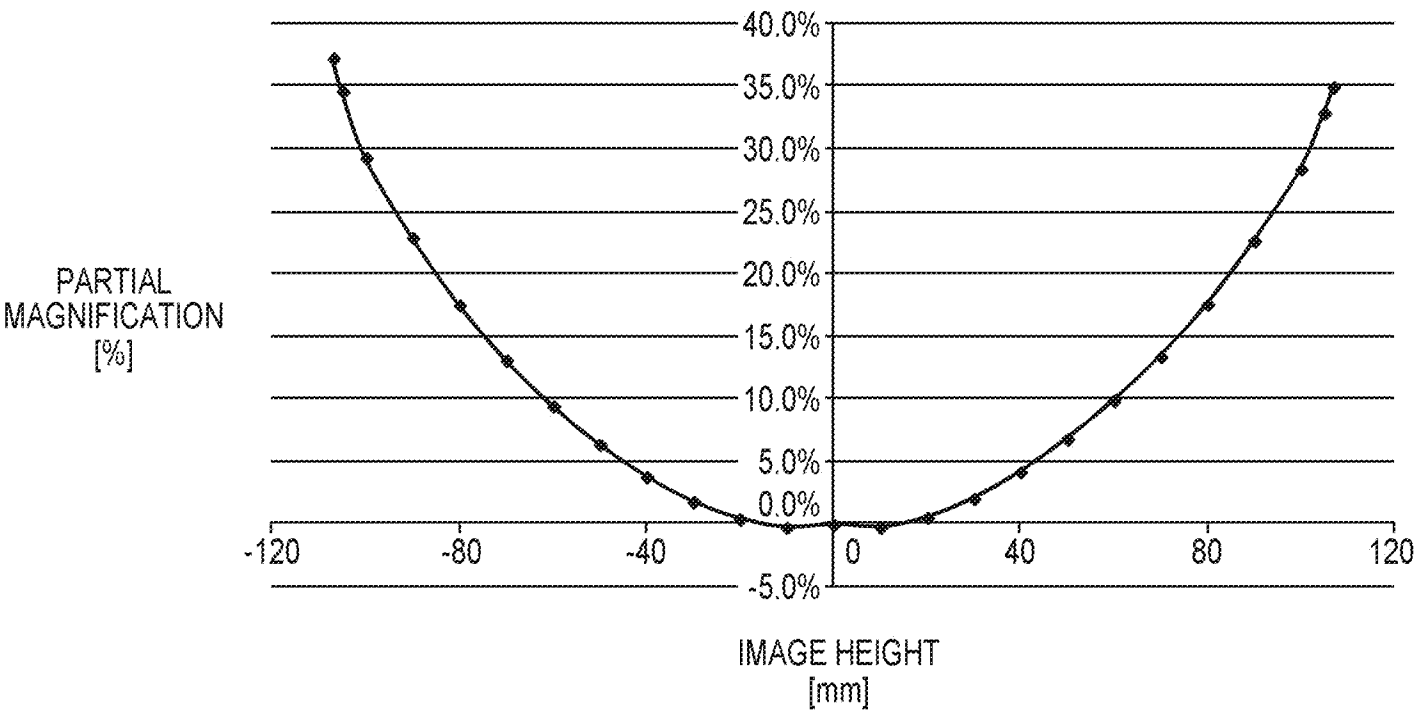
FIG. 3 illustrates an example of a relationship between a partial magnification and an image height on a photosensitive drum.

FIG. 3 illustrates an example of a relationship between partial magnification and an image height on the photosensitive drum 4, in a case where the imaging lens 406 of the present embodiment is used to cause the laser beam 208 to form an image on the photosensitive drum 4 (the scanned surface 407). Note that a case where the image height is 0 is where the spot is on the optical axis of the imaging lens 406, and this is referred to as "on-axis image height" or a "central image height" below. In addition, an image height other than the on-axis image height is referred to below as an "off-axis image height", and the maximum value of an absolute value of the image height is referred to as a "maximum off-axis image height" or an "edge portion image height". As illustrated in FIG. 2A, when the scan width of the scanned surface 407 is defined as W, the maximum off-axis image height (the edge portion image height) on the scanned surface 407 is W/2.

The partial magnification illustrated in FIG. 3 indicates a magnification ratio of each position (image height) in the main scanning direction, and the partial magnification changes in accordance with the scanning speed of the laser beam 208. FIG. 3 illustrates that the scanning speed of the laser beam 208 gradually gets faster going from the on-axis image height (the central image height) to a maximum off-axis image height (an edge portion image height) (in other words, as the absolute value of the image height increases), and thereby the partial magnification increases. The scanning speed of the laser beam 208 is slowest at the on-axis image height (the central image height), and is fastest at a maximum off-axis image height (an edge portion image height). In FIG. 3, for example, the partial magnification of a certain image height being 30% means that the scanning speed of the laser beam 208 at this image height is 1.3 times the scanning speed of the image height where the partial magnification if 0% (the central image height). In addition, the partial magnification being 30% means that, if light is irradiated in only a unit time with respect to the scanned surface 407, an irradiation length of the light in the main scanning direction on the scanned surface 407 is 1.3 times the irradiation length of light when the partial magnification is 0%.

In this way, in the optical scanning apparatus 400 that has an optical configuration as described above, a width of a pixel (dot) formed at each main scanning position (image height) may be uneven due to variation arising in the partial magnification in the main scanning direction. As a result, there is the possibility that a good image quality will not be obtainable. In particular, an angle of view increases as an optical path length from the deflector 405 to the scanned surface 407 of the photosensitive drum 4 shortens. As a result, a difference of scanning speeds between the on-axis image height (the central image height) and a maximum off-axis image height (an edge portion image height) increases, and an influence that variation of partial magnification exerts on image quality increases. Accordingly, in the present embodiment, correction of partial magnification in the main scanning direction is performed. As described later, partial magnification correction is performed by adjusting the frequency or the cycle of the image clock such that the widths of pixels become uniform across all main scanning positions (image height). In the present embodiment, to reduce variation of partial magnification in the main scanning direction due to the imaging lens 406 that does not have a desired fθ characteristic, the partial magnification correction described later is performed so that good image quality can be obtained.

<Exposure Control Configuration>

Figure 4:
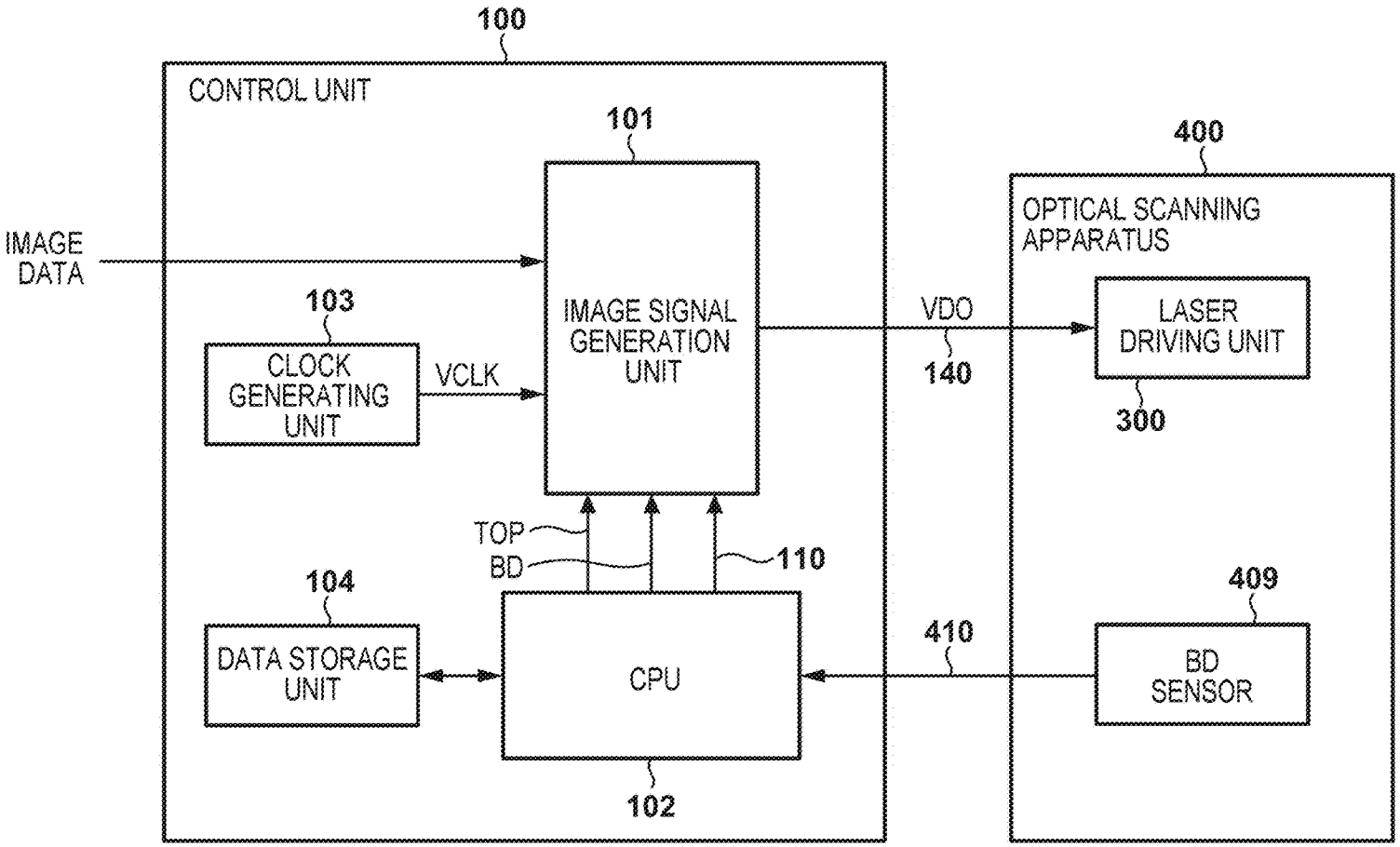
FIG. 4 is a block diagram illustrating an example of a configuration of a control unit that performs control of an optical scanning apparatus.

FIG. 4 is a block diagram that illustrates a configuration of the control unit 100 that performs control of the optical scanning apparatus 400 which exposes the photosensitive drum 4 by the laser beam 208. The control unit 100 has an image signal generation unit 101, a CPU 102, a clock generating unit 103, a data storage unit 104, and the like. The image signal generation unit 101 receives image data from an image scanner or a host computer (not shown), and generates an image signal that corresponds to the received image data as a VDO signal 140. The CPU 102 performs control of the image forming apparatus 1 and control of the image signal generation unit 101. The clock generating unit 103 generates a clock (VCLK) of a predetermined frequency that is used as a clock for the image signal generation unit 101 to operate, and outputs it to the image signal generation unit 101. One cycle of the clock (VCLK) generated by the clock generating unit 103 corresponds to one pixel.

The CPU 102 controls a timing for the image signal generation unit 101 to start output of the VDO signal 140 to the laser driving unit 300, by a TOP signal and a BD signal output to the image signal generation unit 101. The TOP signal is a signal that serves as a reference for a write start of an image in the sub scanning direction (a sub-scanning synchronizing signal), and the BD signal is a signal that serves as a reference for a write start of an image in the main scanning direction (a main scanning synchronizing signal).

The CPU 102 outputs the TOP signal to the image signal generation unit when a sheet fed from the sheet feeding unit 8 reaches a predetermined position in a conveyance path. In addition, the CPU 102 outputs the BD signal to the image signal generation unit 101 based on a detection signal 410 output from the BD sensor 409 when the BD sensor 409 detects the laser beam 208.

The image signal generation unit 101 outputs the generated VDO signal 140 to the laser driving unit 300 in synchronization with the TOP signal and the BD signal outputted from the CPU 102. The laser driving unit 300 causes the light source 401 to emit light by supplying the light source 401 with a driving current based on the VDO signal 140 outputted from the image signal generation unit 101. As described above, the photosensitive drum 4 is exposed by the laser beam 208 emitted by the light source 401, and an electrostatic latent image is formed on the surface of the photosensitive drum 4.

The CPU 102 of the present embodiment further outputs to the image signal generation unit 101, via a control signal 110, correction data to be applied to an image clock generated from the clock (VCLK) supplied from the clock generating unit 103. As described later, the image signal generation unit 101 realizes partial magnification correction by correcting the cycle or the frequency of the image clock based on the correction data from the CPU 102.

<Image Formation Timing and Partial Magnification Correction>

Figure 5A:
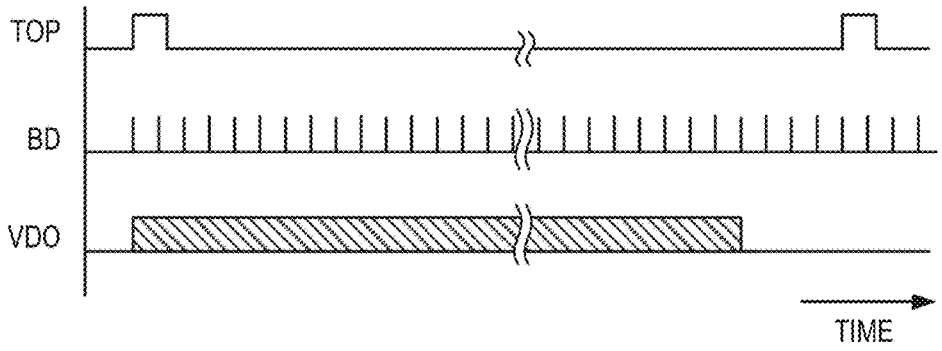
FIGS. 5A and 5B illustrate an example of time charts for a TOP signal, a BD signal, and a VDO signal when image formation is performed on one sheet, and toner images formed based on VDO signals.

FIG. 5A is a time chart for the VDO signal outputted from the image signal generation unit 101 and the BD signal and the TOP signal outputted from the CPU 102 when image formation to one sheet is performed. The TOP signal corresponds to a high-level (an H-level) signal in FIG. 5A, and is a signal for expressing that a leading edge of a sheet fed from the sheet feeding unit 8 has reached a predetermined position. The BD signal corresponds to an H-level signal in FIG. 5A, and is outputted from the CPU 102 to the image signal generation unit 101 in accordance with detection of the laser beam 208 by the BD sensor 409. As illustrated in FIG. 5A, upon receiving the TOP signal from the CPU 102, the image signal generation unit 101 starts output of the VDO signal to the laser driving unit 300 in synchronization with the BD signal. The laser driving unit 300 causes the light source 401 to emit light based on the VDO signal from the image signal generation unit 101 so as to form an electrostatic latent image on the photosensitive drum 4 by the laser beam 208.

Note that, in FIG. 5A, for convenience the VDO signal is expressed as being continuously output in a period over a plurality of BD signals. However, as illustrated in FIG. 5B, the VDO signal is actually output in a predetermined period from after the output of one BD signal until before a next BD signal is outputted.

Figure 5B:
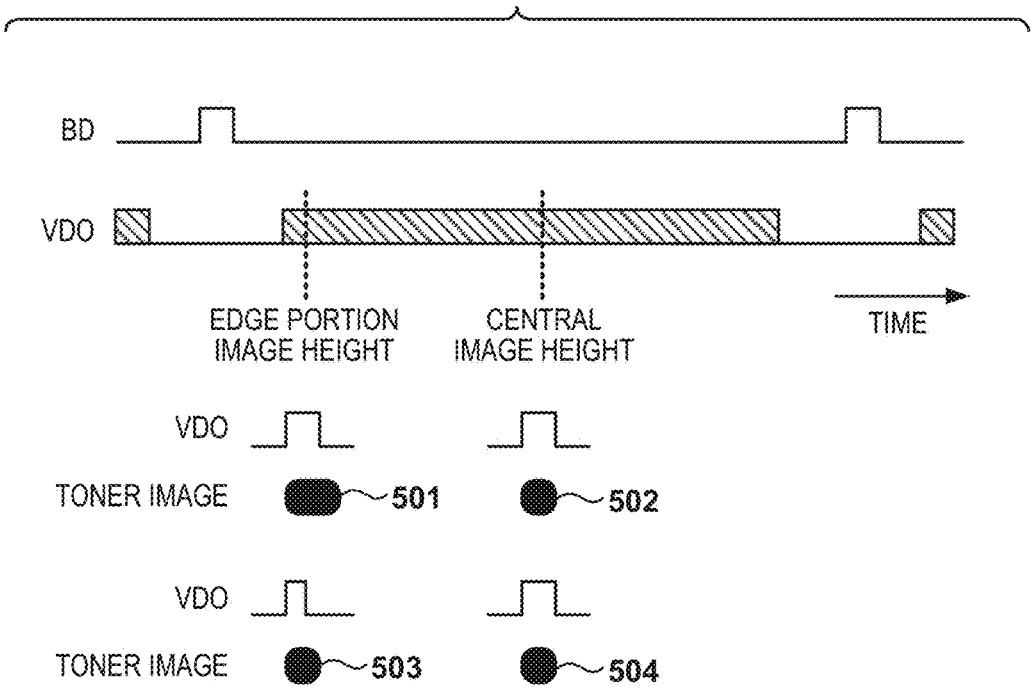

Next, FIG. 5B is a view that magnifies two BD signals that are temporally adjacent in FIG. 5A, and in FIG. 5B, toner images (dots) formed on the scanned surface 407 of the photosensitive drum 4 based on the VDO signal are schematically illustrated. Upon detecting a rising edge of the BD signal, the image signal generation unit 101 starts output of the VDO signal after the passage of a predetermined period, so that forming of the electrostatic latent image is started from a position separated from the edge portion of the photosensitive drum 4 in the main scanning direction by a predetermined distance.

In FIG. 5B is illustrated dots 501 and 502 that are formed on the scanned surface 407 when the VDO signal for causing the light source 401 to emit light is output by the image signal generation unit 101 for the same period at the central image height (the on-axis image height) and an edge portion image height (a maximum off-axis image height). As described above, the scanning speed of the laser beam 208 at the edge portion image height is faster than the scanning speed of the laser beam 208 at the central image height. Accordingly, as illustrated in FIG. 5B, the dot 501 of the edge portion image height has a broader width in the main scanning direction than the dot 502 for the central image height (in other words, the partial magnification of the edge portion image height is bigger than the partial magnification of the central image height).

In the present embodiment, partial magnification correction is performed by adjusting a time span or a cycle of the VDO signal in accordance with a position in the main scanning direction, so that the widths of dots that correspond to respective pixels formed at respective positions (image heights) in the main scanning direction become substantially uniform. For example, as illustrated in FIG. 5B, the light-emitting time of the light source 401 at the edge portion image height is set to be shorter than for the central image height, so that a dot 503 at an edge portion image height is equal in size to a dot 504 at the central image height. This can be realized by adjusting a duration of the H-level in the VDO signal. Note that, the light source 401 is turned on (emits light) when the VDO signal is the H-level, and the light source 401 is turned off (does not emit light) when the VDO signal is the L-level. In the present embodiment, as described later, such correction of the time span of the cycle of the VDO signal is realized by adjustment (modulation) of the image clock used in the image signal generation unit 101.

<Image Signal Generation Unit 101>

Figure 6A:
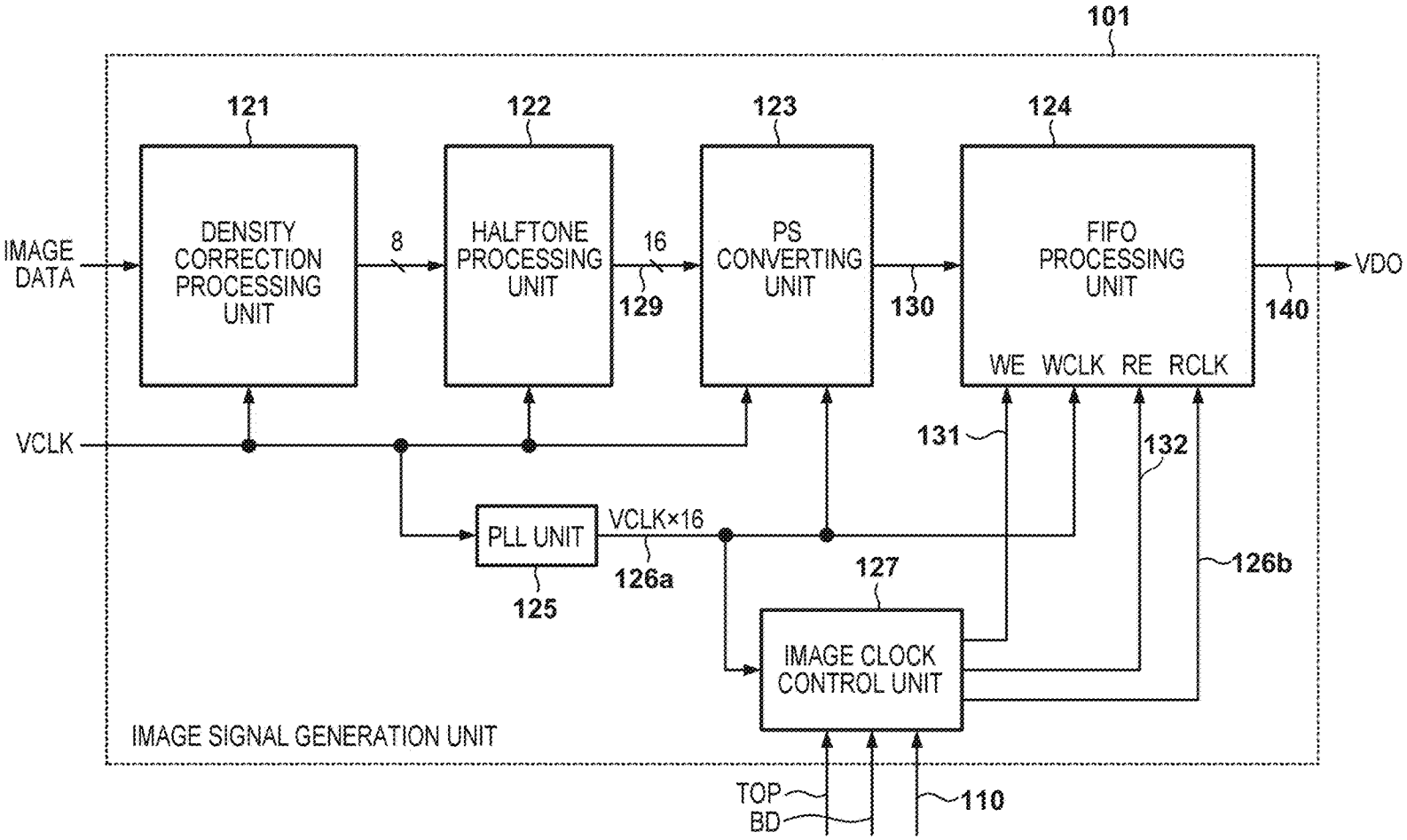
FIG. 6A is a block diagram illustrating an example of a configuration of an image signal generation unit.

FIG. 6A is a block diagram that illustrates a configuration of the image signal generation unit 101. The image signal generation unit 101 has a density correction processing unit 121, a halftone processing unit 122, a parallel/serial (PS) converting unit 123, a FIFO processing unit 124, a PLL unit 125, and an image clock control unit 127. Note that the FIFO processing unit 124 has a line buffer (not shown) for buffering image data by units of one line in the main scanning direction.

The density correction processing unit 121, the halftone processing unit 122, and the PS converting unit 123 operate in synchronization with the clock (VCLK) supplied from the clock generating unit 103. The density correction processing unit 121 performs density correction processing such as gamma correction with respect to inputted image data. Note that, in the present embodiment, the image data is assumed to be data in which the tone of each pixel is expressed by 8 bits. The density correction processing unit 121 outputs, in a parallel format, image data having 8 bits per 1 pixel after the density correction processing, to the halftone processing unit 122.

Figure 7A:
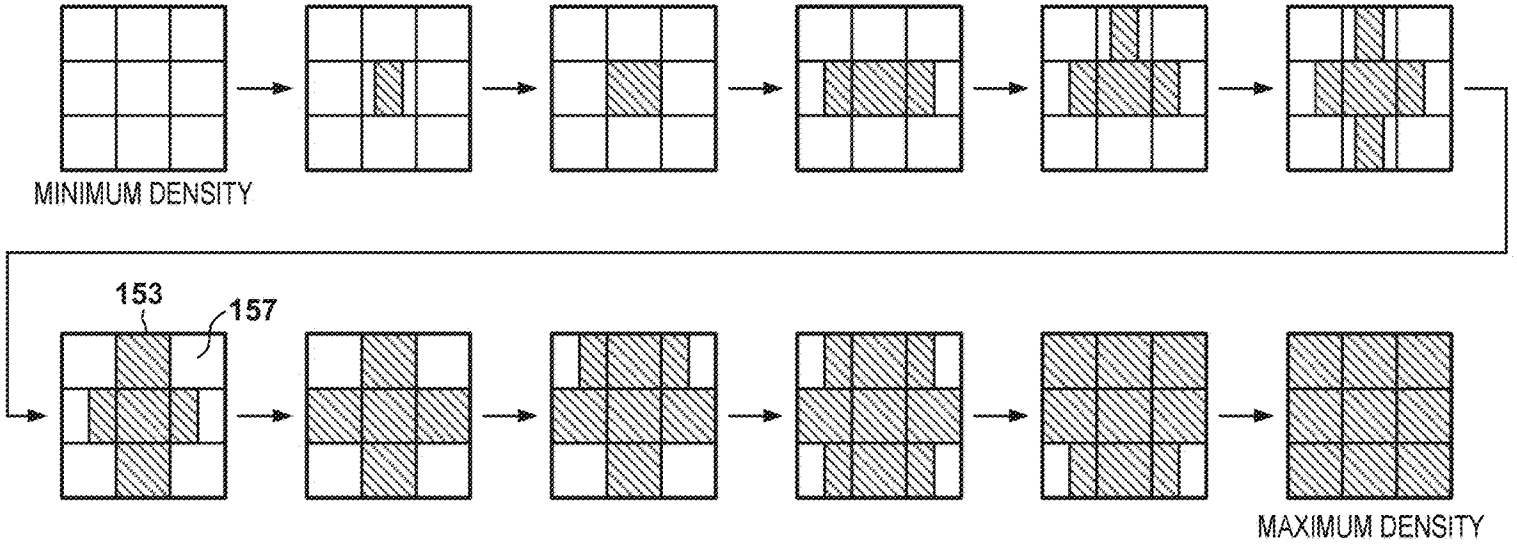
FIGS. 7A and 7B are examples of screens used in screen processing by a halftone processing unit.

The halftone processing unit 122 performs halftone processing (screen processing) on the inputted image data, and outputs image data 129 after the halftone processing to the PS converting unit 123. FIG. 7A illustrates an example of screens used in screen processing by the halftone processing unit 122, and screens that respectively correspond to tone values (densities) are expressed by a matrix 153 having 200 lines of 3 pixels×3 pixels in the main scanning direction and the sub scanning direction. In each of the matrix 153, a white portion corresponds to a portion for causing the light source 401 to not emit light (OFF), and a portion that is not white corresponds to a portion for causing the light source 401 to emit light (ON). Each pixel 157 that configures a matrix 153 is a unit for partitioning image data to form one dot at 600 dpi on the scanned surface 407, for example.

Figure 7B:
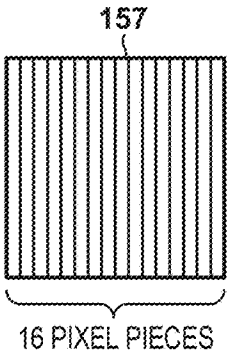

In the present embodiment, as illustrated in FIG. 7B, one pixel 157 is configured by 16 pixel pieces that each have a width of 1/16 of one pixel in the main scanning direction. In other words, each pixel after the halftone processing is expressed by 16 bits. Turning on and turning off of the light source 401 is switched for each pixel piece. Accordingly, it is possible to express one of 16 tones in one pixel. In this way, the halftone processing unit 122 outputs the image data 129 that has 16 bits per one pixel to the PS converting unit 123 in the parallel format.

The PLL unit 125 generates an image clock 126*a* (VCLK×16) by multiplying the frequency of the clock (VCLK) supplied from the clock generating unit 103 by 16 (corresponding to the number pixel pieces per one pixel). In other words, a clock (VCLK×16) for which one cycle corresponds to one pixel piece is generated from the clock (VCLK) for which one cycle corresponds to one pixel. The generated image clock 126*a* is supplied to the PS converting unit 123 and the image clock control unit 127, and is also supplied to the FIFO processing unit 124 as a write clock (WCLK).

The PS converting unit 123 converts the inputted image data 129 from the parallel format to a serial format (in other words, converts, for each one pixel, the 16 bits of data in the parallel format to the serial format). Furthermore, the PS converting unit 123 outputs image data 130 after the conversion to the FIFO processing unit 124, in synchronization with the image clock 126*a* supplied from the PLL unit 125.

Writing (write) of image data to a line buffer of the FIFO processing unit 124 is controlled by a write enable (WE) signal 131 outputted from the image clock control unit 127. Reading (read) of image data to a line buffer of the FIFO processing unit 124 is controlled by a read enable (RE) signal 132 outputted from the image clock control unit 127. When the WE signal 131 switches from an L-level to an H-level (an enabled state), the FIFO processing unit 124 stores the image data outputted from the PS converting unit 123 in the line buffer in units of one line in the main scanning direction, in synchronization with the image clock 126*a*.

In addition, when the RE signal 132 switches from the L-level to the H-level (an enabled state), the FIFO processing unit 124 outputs the image data stored in the line buffer, in the serial format as the VDO signal 140. At that time, the FIFO processing unit 124 outputs the VDO signal 140 in synchronization with the image clock 126*b* supplied as a read clock (RCLK) from the image clock control unit 127. The image clock 126*b* is an image clock obtained, in the image clock control unit 127, by correcting the image clock 126*a* based on the correction data for the partial magnification correction. The laser driving unit 300 causes the laser beam (light beam) 208 to be emitted from the light source 401, by causing the light source 401 to emit light in accordance with the VDO signal 140 outputted in synchronization with the image clock 126*b*. In this way, the image clock 126*b* is used to control a timing at which the light source 401 emits light.

<Partial Magnification Correction by Image Signal Generation Unit 101>

Figure 8:
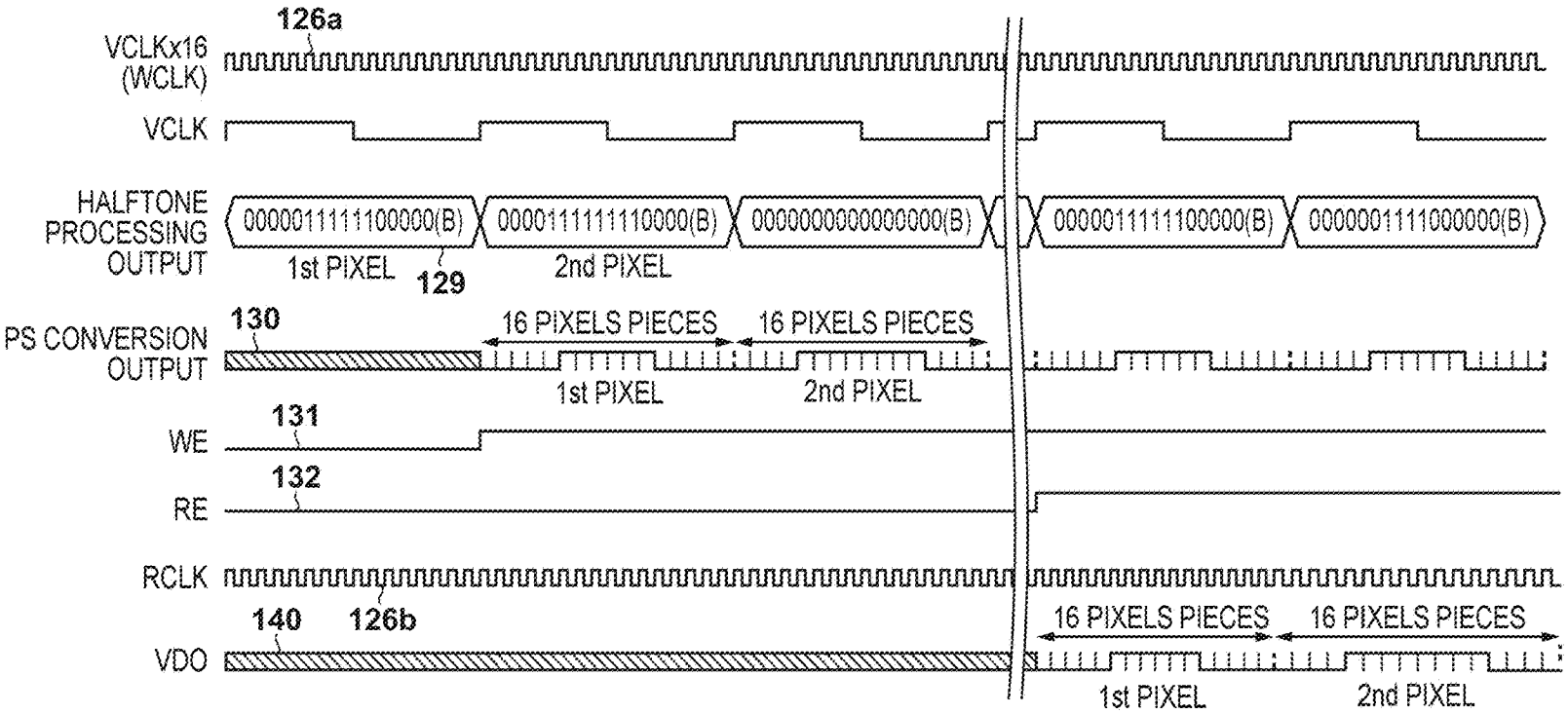
FIG. 8 is a time chart illustrating operation of the image signal generation unit.
Figure 9A:
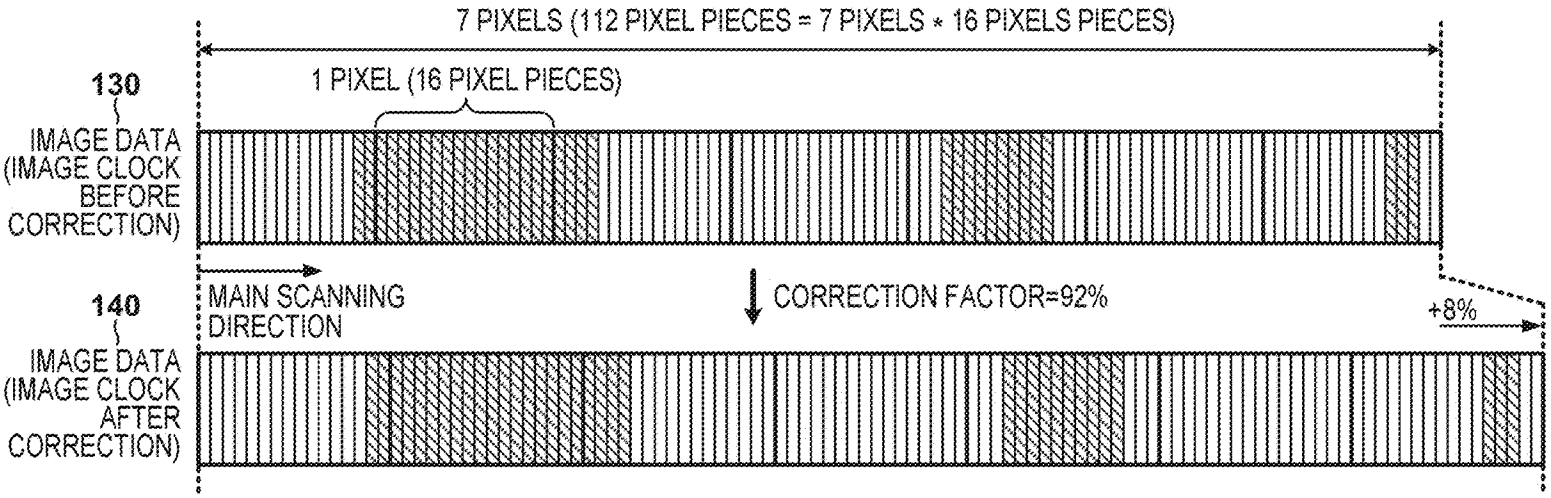
FIG. 9A illustrates an example of image data before correction of partial magnification.
Figure 9B:
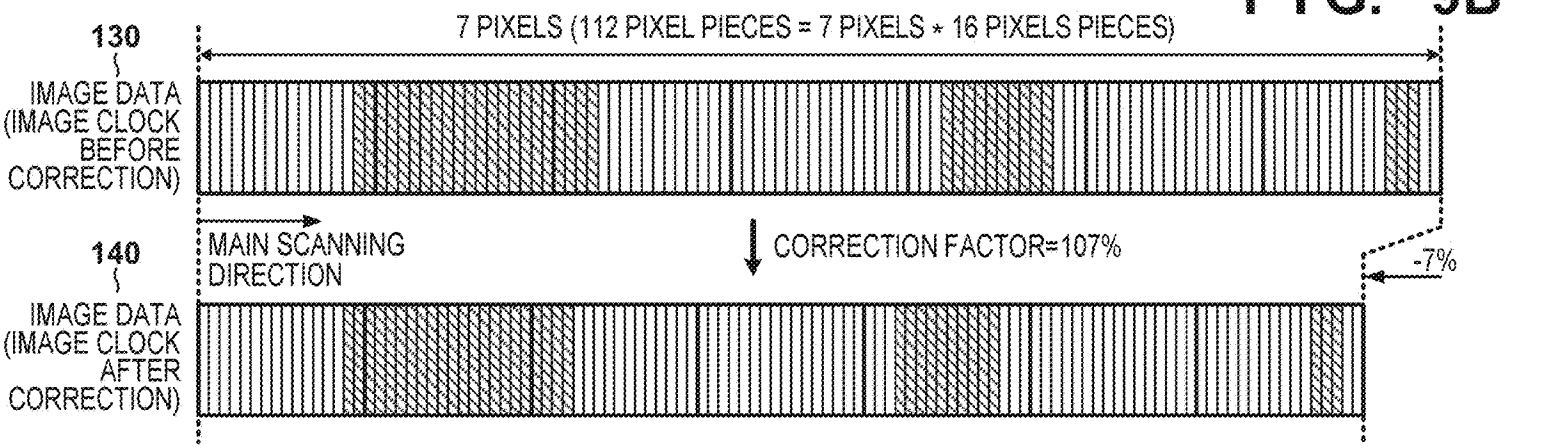
FIG. 9B illustrates an example of image data after correction of partial magnification.

In the present embodiment, the partial magnification correction by the image signal generation unit 101 with respect to image data is, as described above, realized by correcting the cycle or the frequency of an image clock based on correction data (modulating the image clock). With reference to FIG. 8, FIG. 9A and FIG. 9B, a more detailed explanation is given below regarding the partial magnification correction performed by the image signal generation unit 101.

FIG. 8 is a time chart that illustrates operation of the image signal generation unit 101. One cycle of the clock (VCLK) supplied by the clock generating unit 103 corresponds to one pixel. As illustrated in FIG. 8, the halftone processing unit 122, in synchronization with the clock (VCLK) supplied from the clock generating unit 103, outputs, as parallel data, each pixel of the image data 129 after the halftone processing, where each pixel is expressed by 16 bits.

The PS converting unit 123, in synchronization with the image clock 126*a* supplied from the PLL unit 125, outputs each bit (single pixel piece) of serial data (the image data 130) obtained by subjecting the image data 129 to a PS conversion. In the present embodiment, the frequency of the image clock 126*a* generated by the PLL unit 125 is 16 times the frequency of the clock (VCLK) supplied from the clock generating unit 103. One cycle of the image clock 126*a* corresponds to one bit outputted from the PS converting unit 123 (in other words, a pixel piece having a width of 1/16 of one pixel).

Based on the TOP signal and the BD signal from the CPU 102, the image clock control unit 127 switches the WE signal 131 from the L-level to the H-level in accordance with the timing at which output of the image data from the PS converting unit 123 to the FIFO processing unit 124 is started. With this the image data outputted from the PS converting unit 123 is stored in the line buffer of the FIFO processing unit 124 in synchronization with the image clock 126*a* (WCLK).

The image clock control unit 127 switches the RE signal 132 from the L-level to the H-level based on the TOP signal and the BD signal from the CPU 102. By this, the FIFO processing unit 124 starts outputting the image data stored in the line buffer as the VDO signal 140, in synchronization with the image clock 126*b* (RCLK) supplied from the image clock control unit 127.

The image clock 126*b* (RCLK) is an image clock obtained by correcting the frequency (or the cycle) of the image clock 126*a* generated by the PLL unit 125. In the present embodiment, the image clock control unit 127 controls the image clock 126*b* (RCLK) supplied to the FIFO processing unit 124 such that the partial magnification in the main scanning direction of one line image formed on the scanned surface 407 of the photosensitive drum 4 is corrected.

In a case of making the partial magnification smaller (making the image in the main scanning direction shorter), the image clock control unit 127 performs correction to partially increase the frequency (partially reduce the cycle) of the image clock 126*a* serving as a reference. In this case, by the VDO signal 140 being outputted from the FIFO processing unit 124 in synchronization with the corrected image clock 126*b* (RCLK), the VDO signal 140 is corrected so that its cycle (frequency) or time span becomes shorter. Meanwhile, in a case of making the partial magnification larger (making the image in the main scanning direction longer), the image clock control unit 127 performs correction to partially increase the frequency (partially reduce the cycle) of the image clock 126*a* serving as a reference. In this case, by the VDO signal 140 being outputted from the FIFO processing unit 124 in synchronization with the corrected image clock 126*b* (RCLK), the VDO signal 140 is corrected so that its cycle (frequency) or time span becomes longer. In this way, partial magnification correction is realized by the cycle (frequency) or the time span of the VDO signal 140 being corrected.

In the example of FIG. 8, the VDO signal 140 corresponding to a first pixel (1st pixel) is outputted in synchronization with the image clock 126*b* (RCLK) for which the cycle has been shortened to 15/16 of that of the image clock 126*a* serving as a reference. By this, correction is performed so that the width of a dot that corresponds to the first pixel shrinks in the main scanning direction. In addition, the VDO signal 140 corresponding to a second pixel (2nd pixel) is outputted in synchronization with the image clock 126*b* (RCLK) for which the cycle has been lengthened to 18/16 of that of the image clock 126*a* serving as a reference. By this, correction is performed so that the width of a dot that corresponds to the second pixel extends in the main scanning direction.

Next, FIGS. 9A and 9B illustrate an example of image data before and after correction of partial magnification. In the examples of FIGS. 9A and 9B, a region of seven pixels that are consecutive in the main scanning direction out of the serial data (the image data 130) outputted from the PS converting unit 123 is taken as a target, and a partial magnification correction is performed in the target region. FIG. 9A is an example of performing a correction to increase the partial magnification in the target region by 8%, and FIG. 9B is an example of performing a correction to reduce the partial magnification in the target region by 7%. The image clock control unit 127 of the present embodiment generates the image clock 126*b* by correcting the frequency of the image clock 126*a* to the frequency obtained by multiplying the frequency of the image clock 126*a* by a correction factor for the partial magnification correction.

In the example of FIG. 9A, the image clock control unit 127 takes a region of a group of 112 consecutive pixel pieces that correspond to 7 consecutive pixels as a target, and corrects the frequency of the image clock 126*a* by a correction factor of 92% (in other words, reduces the frequency by 8%). By this, it is possible to increase the partial magnification of the image in the target region by 8%. In other words, it is possible to extend, in the main scanning direction, each pixel of the target region formed on the scanned surface 407 of the photosensitive drum 4.

Meanwhile, in the example of FIG. 9B, the image clock control unit 127 takes a region of a group of 112 consecutive pixel pieces that correspond to 7 consecutive pixels as a target, and corrects the frequency of the image clock 126*a* by a correction factor of 107% (in other words, increases the frequency by 7%). By this, it is possible to reduce the partial magnification of the image in the target region by 7%. In other words, it is possible to shrink, in the main scanning direction, each pixel of the target region formed on the scanned surface 407 of the photosensitive drum 4.

As described above, the scanning speed of the laser beam 208 changes in accordance with the main scanning position (image height) on the scanned surface 407 scanned by the laser beam 208. As a result, the partial magnification changes in accordance with the image height. As illustrated in FIG. 3, as the absolute value of the image height increases, the scanning speed of the laser beam 208 gets faster and the partial magnification increases. Accordingly, the image signal generation unit 101 (the image clock control unit 127) performs a partial magnification correction using a correction factor set in accordance with the image height on the photosensitive drum 4 to, such that the partial magnification in an image region, in which an image is formed in a scanning region of one line by the laser beam 208, becomes uniform.

By such a partial magnification correction, it is possible to perform a correction such that the widths of dots that respectively correspond to pixels formed at respective main scanning positions (image heights) become substantially uniform. Note that correction may be performed such that the width of each dot is approximately uniform, allowing for a certain amount of variation. In addition, correction of the cycle of the frequency of an image clock by the image clock control unit 127 may be performed for each pixel, or may be performed in units of a plurality of pixels.

<Image Clock Control Unit 127>

Figure 6B:
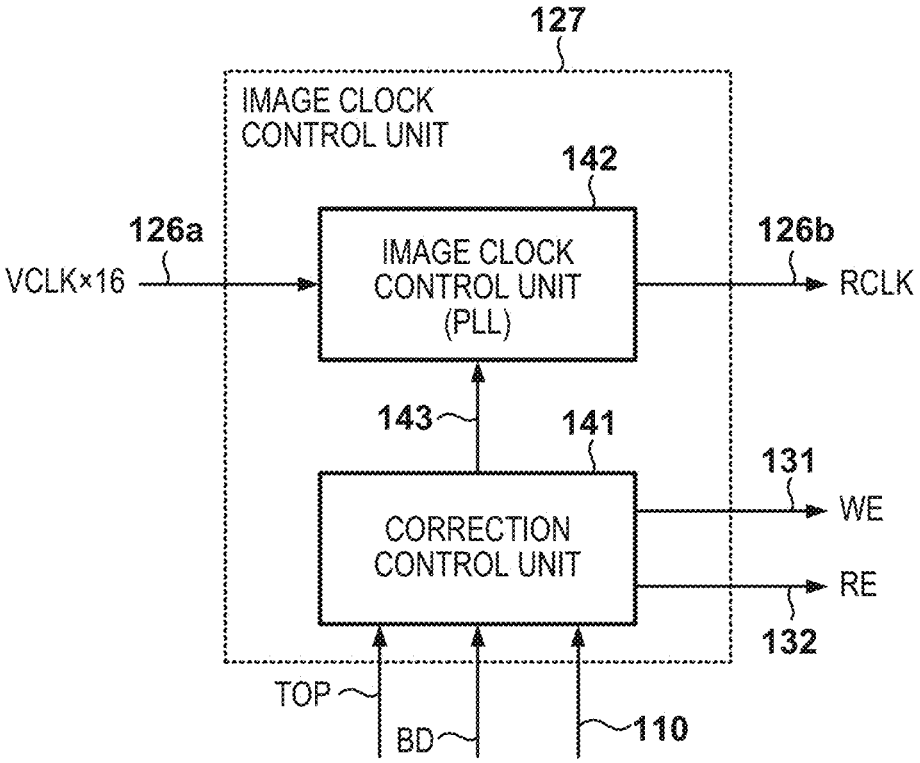
FIG. 6B is a block diagram illustrating an example of a configuration of an image clock control unit.

Next, a more detailed explanation is given for configuration and operation of the image clock control unit 127. FIG. 6B is a block diagram that illustrates a configuration of the image clock control unit 127 in the image signal generation unit 101. The image clock control unit 127 has a correction control unit 141 and an image clock correction unit 142.

The correction control unit 141 controls the FIFO processing unit 124 by controlling, in accordance with the TOP signal and the BD signal outputted from the CPU 102, the WE signal 131 and the RE signal 132 to output to the FIFO processing unit 124, as described above. In addition, the correction control unit 141 controls the image clock correction unit 142 by controlling a setting signal 143 to output to the image clock correction unit 142.

The image clock correction unit 142 corrects the frequency or the cycle of the inputted image clock 126*a* based on the setting signal 143 outputted from the correction control unit 141, and outputs the corrected image clock 126*b* (RCLK) to the FIFO processing unit 124. In other words, the frequency (cycle) of the image clock 126*a* is set as a reference, and a clock having a frequency (cycle) corrected from the reference frequency (cycle) is generated as the image clock 126*b* (RCLK) and supplied to the FIFO processing unit 124.

The CPU 102 of the present embodiment outputs to the correction control unit 141, via the control signal 110, data indicating a correction factor for the frequency of the image clock 126*a* at each image height on the photosensitive drum 4 as correction data for the partial magnification correction. This correction data is stored in the data storage unit 104 in advance, and is read out from the data storage unit 104 and used by the CPU 102. Note that registers for storing the correction data may be provided in the image clock control unit 127 or the image signal generation unit 101. In this case, the correction control unit 141 reads out the correction data stored in the registers and uses it.

In addition, the image clock correction unit 142 of the present embodiment may be configured by a PLL (frequency synthesizer) circuit that can change (shift) the frequency of the inputted image clock 126*a* in accordance with the setting signal 143. A PLL circuit that configures the image clock correction unit 142 may be provided with a programmable frequency divider for which a setting of a division ratio can be changed by an external unit, for example. In this case, the correction control unit 141 performs, using the setting signal 143, a setting of the programmable frequency divider in accordance with the correction factor indicated by the correction data, thereby setting the frequency of the corrected image clock 126*b*. By this, the image clock correction unit 142 corrects the frequency of the inputted image clock 126*a* to the frequency set by the setting signal 143, thereby generating the corrected image clock 126*b*. The image clock correction unit 142 further outputs the generated image clock 126*b* to the FIFO processing unit 124.

<Frequency Control of Image Clock>

Next, with reference to FIG. 10A, FIG. 10B and FIGS. 11A to 11C, explanation is given regarding frequency control of the image clock 126*b* that is executed by the image clock control unit 127 while the scanned surface 407 of the photosensitive drum 4 is scanned in the main scanning direction by the laser beam 208.

The image clock control unit 127 (the correction control unit 141) can identify the scanning position by the laser beam 208 on the photosensitive drum 4, based on the timing at which the BD signal is outputted from the CPU 102. Specifically, it can be identified by counting, from the output timing of the BD signal, the image clock 126*a* serving as a reference (hereinafter may be referred to as the "reference image clock 126*a*") supplied from the clock generating unit 103. In the present embodiment, the frequency of the reference image clock 126*a* (hereinafter may be referred to as the "reference frequency") is set in accordance with the overall magnification in the image region (the average value of the magnifications in the image region). In other words, it is possible to obtain the scanning time per one pixel by the laser beam 208, from the period required to scan by the laser beam 208 in the image region and the number of pixels in the image region, and to set a reciprocal of the obtained scanning time as the reference frequency.

The image signal generation unit 101 (the image clock control unit 127) performs the partial magnification correction described above in the image region in which an image is formed on the photosensitive drum 4 within the scanning region of one line that is scanned in the main scanning direction by the laser beam 208. Note that the scanning region in the present specification includes not only a region on the scanned surface 407 of the photosensitive drum 4 but also a region outside of the scanned surface 407. In addition, a non-image region, which is a region other than the image region, includes regions other than the image region on the scanned surface 407, and regions outside of the scanned surface 407 in the scanning region of one line.

Specifically, in the image region identified based on the BD signal, the image clock control unit 127 generates the image clock 126*b* by correcting the frequency of the reference image clock 126*a* from the reference frequency in accordance with the correction data from the CPU 102. Note that the image clock control unit 127 generates the image clock 126*b* such that the frequency of the image clock 126*b* is equal to the reference frequency in the non-image region, which is a region other than the image region. By this, the frequency of the image clock 126*b* outputted to the FIFO processing unit 124 is controlled. The FIFO processing unit 124 outputs the VDO signal 140 to the laser driving unit 300 in synchronization with the image clock 126*b* (RCLK) supplied from the image clock control unit 127. In this way, the partial magnification of the image of one line formed in the main scanning direction is corrected by controlling, in accordance with the correction data, the frequency of the image clock 126*b* for output of the VDO signal 140.

Figure 10A:
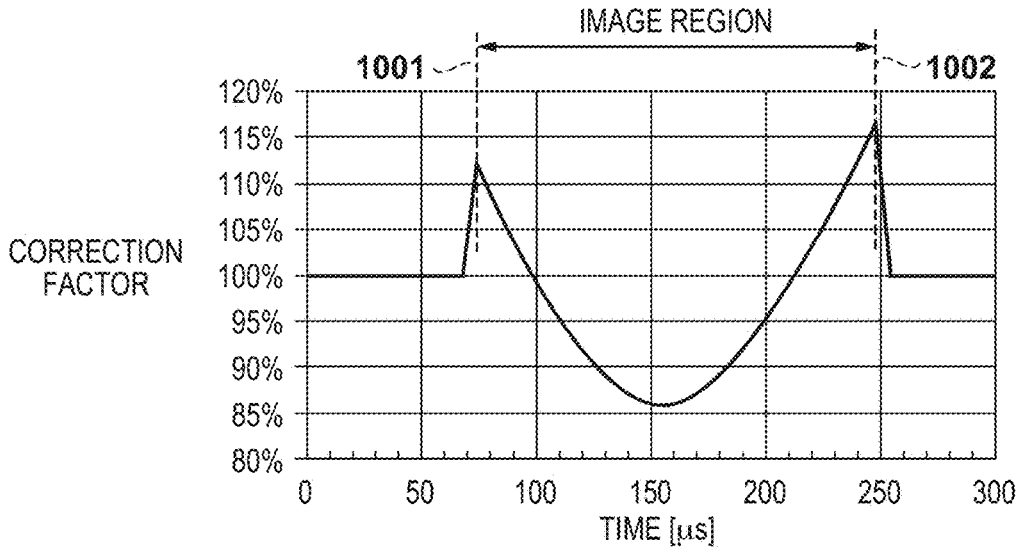
FIGS. 10A and 10B illustrate examples of temporal change of a correction factor of the frequency of an image clock.
Figure 10B:
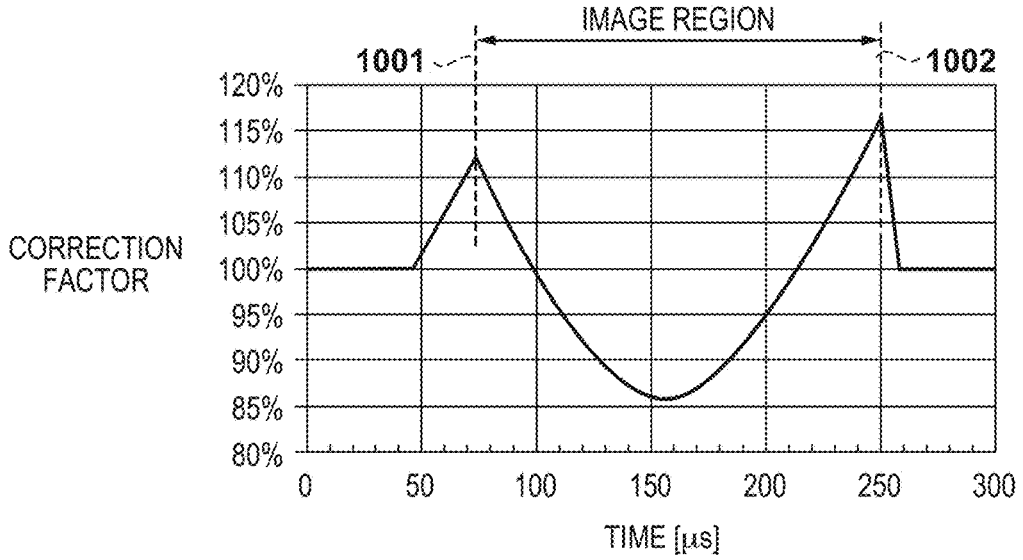

FIGS. 10A and 10B exemplify temporal change, from timings at which the BD signal is outputted, of the correction factor of the frequency of an image clock while the laser beam 208 scans the scanning region of one line in the main scanning direction. Note that FIG. 10A illustrates frequency control of a comparative example in contrast to the present embodiment, and FIG. 10B illustrates frequency control according to the present embodiment.

In FIGS. 10A and 10B, the correction factor indicates a ratio of the corrected image clock 126*b* (RCLK) with respect to the reference frequency, and a correction factor of 100% corresponds to the reference frequency. In other words, the frequency of the corrected image clock 126*b* (RCLK) is obtained by multiplying the correction factor indicated in FIG. 10A or 10B by the reference frequency, at each image height (each scanning position) on the photosensitive drum 4. Therefore, the frequency of the image clock 126*b* (RCLK) changes similarly to the correction factor illustrated in FIG. 10A or 10B in one main scanning line that takes the output timing of the BD signal as a reference. As illustrated in FIGS. 10A and 10B, in the range of an image region from a start point 1001 to an end point 1002, the frequency of the image clock 126*b* (RCLK) is corrected in accordance with the image height so as to correct the partial magnification of each image height as illustrated in FIG. 3. Accordingly, the correction factor in the range from the start point 1001 to the end point 1002 is set as values that correspond to the partial magnification at each image height.

In the comparative example illustrated in FIG. 10A, the frequency of the image clock 126*b* is maintained at the reference frequency until immediately prior to the start point 1001 of the image region, from the output timing of the BD signal (time 0). Subsequently, the frequency of the image clock 126*b* is controlled to switch with a comparatively large amount of change (10% or more) from the reference frequency to a frequency corresponding to the correction factor at an edge portion image height (approximately 112%) immediately prior to the start point 1001 of the image region. In this case, it is necessary for completion, by the start point 1001 of the image region, of switching of the frequency of the image clock 126*b* to the frequency corresponding to the correction factor at the edge portion image height. However, in the image clock control unit 127, it is possible for an error to occur in control of the frequency of the image clock 126*b* due to a response property of the PLL circuit in the image clock correction unit 142.

Figure 11A:
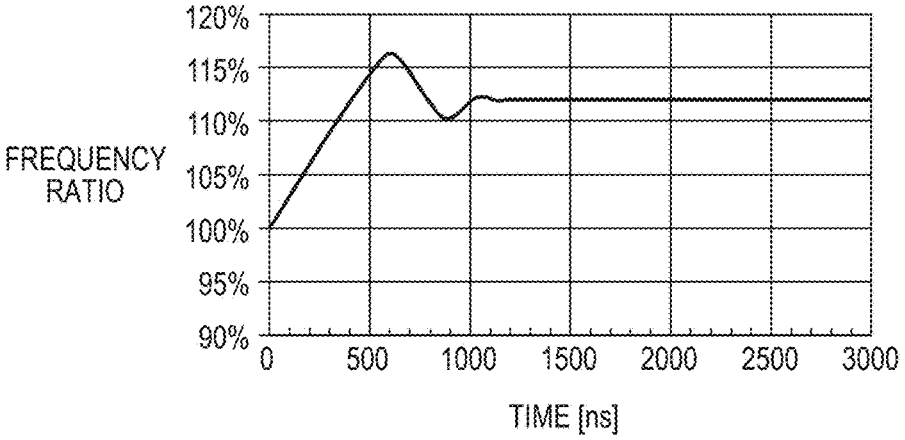
FIGS. 11A to 11C illustrate a response property of a PLL circuit in an image clock correction unit.
Figure 11B:
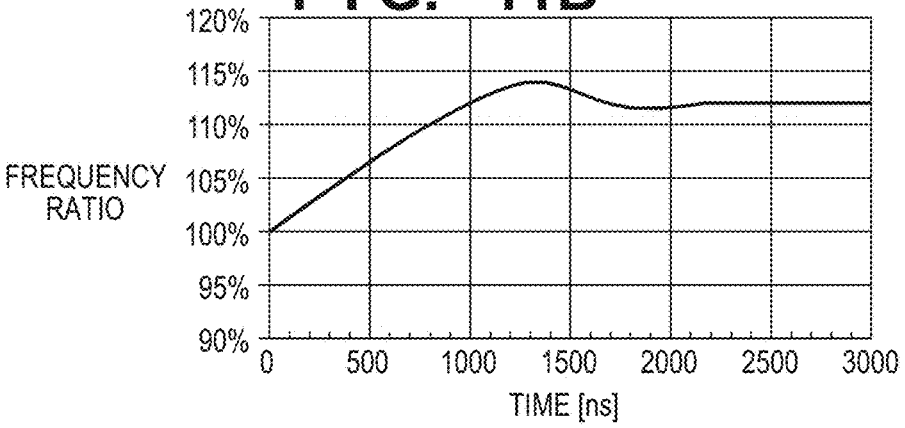
Figure 11C:
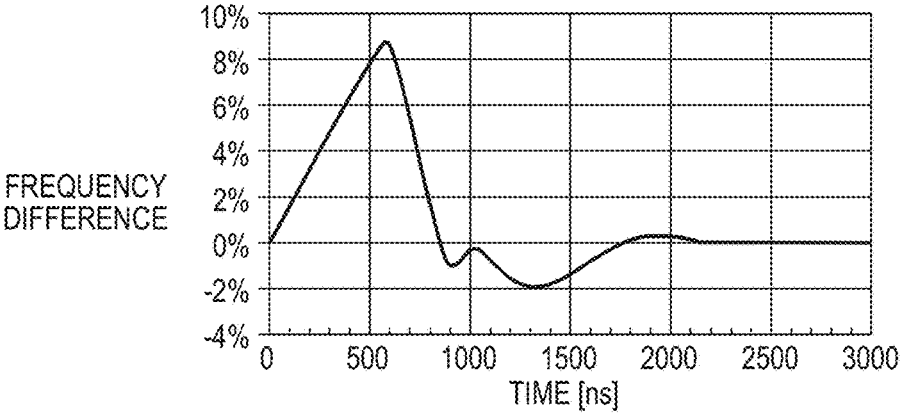

FIGS. 11A, 11B, and 11C illustrate the response property of the PLL circuit in the image clock correction unit 142 for cases of switching the frequency of the image clock 126*b* at the start point 1001 of the image region, as illustrated in FIG. 10A. In FIGS. 11A, 11B, and 11C is illustrated a ratio (frequency ratio) with respect to a reference frequency, in which the frequency of output signal of the PLL circuit (the image clock 126*b*) at the output timing of the BD signal (time 0) is taken as the reference frequency (100%). In addition, FIG. 11A illustrates a case in which the PLL circuit has a fast response property, FIG. 11B illustrates a case in which the PLL circuit has a slow response property, and FIG. 11C illustrates a difference between the frequency ratio illustrated in FIG. 11A and the frequency ratio illustrated in FIG. 11B.

A PLL circuit having a fast response property can switch the frequency in a short period as illustrated in FIG. 11A, even when switching the frequency by a large amount of change as illustrated in FIG. 10A. However, a PLL circuit having a slow response property requires a long time to switch the frequency when switching the frequency by a large amount of change, as illustrated by FIG. 11B. The difference between the response properties of such PLL circuits is due to the influence of variations in peripheral circuit constants, surrounding temperature, power supply voltage, or the like in addition to variation in properties of the PLL circuits.

In a case of controlling an image clock by a large amount of change (for example 10% or more) to use the imaging lens 406 that does not have a desired fθ characteristic as in the image forming apparatus 1 of the present embodiment, it is more likely to be influenced by such a difference in the response properties of PLL circuits. Specifically, if the response property of the PLL circuit is slow, there is the possibility that switching of the frequency of the image clock 126*b* will not be in time for the start point 1001 of the image region, even if the switching of the frequency of the image clock 126*b* is performed by using the correction factor illustrated in FIG. 10A. For example, as illustrated in FIG. 11C, the integral of the difference in frequencies between a case in which the response property of the PLL circuit is slow and a case in which it is fast may exceed 150%. In such a case, this gives a result in which a misalignment of 1.5 pixels or more in the main scanning direction may occur in an image formed on the photosensitive drum 4 due to a difference in the response property of PLL circuits. This leads to an image defect such as moire or color misregistration. Accordingly, it is necessary for switching of the frequency of the image clock 126*b* at the start point 1001 of the image region to be performed so that the influence of the difference of response properties of PLL circuits in the image clock correction unit 142 can be suppressed.

Accordingly, considering differences of response properties of PLL circuits, the image clock control unit 127 of the present embodiment performs control (correction) of the frequency of the image clock so that the frequency of the image clock to apply to one line in the main scanning direction changes smoothly in a non-image region. Specifically, in the main scanning direction in which the laser beam 208 scans the scanning region of one line, the correction control unit 141 controls the frequency of the image clock 126*b* so that the partial magnification of each position in an image region in which an image is formed is corrected. Furthermore, when controlling the frequency of the image clock 126*b*, the correction control unit 141 makes the change rate (the slope) in non-image regions being other than the image region be smaller than the change rate in the image region, where the change rate is the change amount of the frequency of the image clock 126*b* per unit time.

FIG. 10B illustrates an example of a correction factor applied to the frequency of the image clock 126*b* (RCLK), according to the present embodiment. In the present embodiment, as illustrated in FIG. 10B, the frequency of the image clock 126*b* is controlled by a change rate smoother than the comparative example illustrated in FIG. 10A, in the non-image region from the output timing (time 0) of the BD signal until the start point 1001 of the image region Specifically, the frequency of the image clock 126*b* is controlled such that the change rate (the change amount per unit time) of the frequency of the image clock 126*b* in the non-image region becomes smaller than the change rate in the image region from the start point 1001 to the end point 1002. Note that the start point 1001 corresponds to an edge portion of a side where scanning of the image region by the laser beam 208 starts.

In the example illustrated in FIG. 10B, in a duration from when the laser beam 208 starts scanning the scanning region of one line until it reaches the start point 1001, the correction control unit 141 changes the frequency of the image clock 126*b* from the reference frequency to the target frequency at the start point 1001. The target frequency is a frequency for performing the partial magnification correction, and, as described above, corresponds to a correction factor (approximately 112%) set in accordance with an image height on the photosensitive drum 4. In addition, the correction control unit 141 changes the frequency of the image clock 126*b* by a change rate smaller than the change rate in the image region.

In the present embodiment, control of the frequency of the image clock 126*b* from the reference frequency may be started such that the frequency of the image clock 126*b* reaches the target frequency by the timing when the laser beam 208 reaches the start point 1001, as illustrated in FIG. 10B. In addition, frequency control may be performed at a constant change rate that is smaller than the change rate in the image region, in a duration from the timing when control of the frequency of the image clock 126*b* from the reference frequency to the target frequency is started until the frequency of the image clock 126*b* reaches the target frequency.

By such control, it becomes possible to control the frequency of the image clock 126*b* to be a frequency that corresponds to a correction factor for appropriately performing a partial magnification correction at the start point 1001 (an edge portion image height) of the image region, without depending on the PLL circuit in the image clock correction unit 142. In other words, even if the PLL circuit in the image clock correction unit 142 has a slow response property, it is possible to control the frequency of the image clock 126*b* to be a frequency suitable for a partial magnification correction in the image region. Accordingly, it is possible to suppress a reduction of the accuracy of a partial magnification correction in the image region.

In the image clock control unit 127, the correction control unit 141 controls the image clock correction unit 142, which generates the image clock 126*b* from the reference image clock 126*a*, so that the frequency of the image clock 126*b* changes as described above. In the present embodiment, the correction control unit 141 controls the frequency of the image clock 126*b* generated by the image clock correction unit 142 in accordance with correction data from the CPU 102. This can be realized by preparing in advance correction data that indicates a correction factor as illustrated in FIG. 10B, and storing it in advance in the data storage unit 104. In such a case, the CPU 102 may read out correction data that is stored in the data storage unit 104, and provide it to the correction control unit 141.

Note that, while scanning of one line by the laser beam 208 is performed, it is possible to set, to any value, the change rate for the image clock 126*b* to apply to a non-image region after the end point 1002 of the image region. In FIG. 10B, as an example, the correction factor of the image clock 126*b* is set so that the frequency of the image clock 126*b* changes to the reference frequency by a large change rate at the end point 1002 of the image region. In such a case, even if the PLL circuit in the image clock correction unit 142 has a slow response property and delay of control of the image clock 126*b* occurs, an error occurring in the frequency of the image clock 126*b* does not influence a partial magnification correction in the image region.

As explained above, by virtue of the present embodiment, in the image forming apparatus 1 that does not use an imaging lens (a scanning lens) having a desired fθ characteristic, it is possible to prevent a reduction of accuracy of partial magnification correction due to an error occurring in frequency control of the image clock 126*b*.

Note that, while focus was given to the change rate of the frequency of the image clock 126*b* in the example described above, the correction control unit 141 may decide the frequency of the image clock 126*b* in a non-image region, which is a region other than the image region, in accordance with the frequency of the image clock 126*b* in the image region. In such a case, the correction control unit 141 may set the frequency of the image clock 126*b* in the non-image region to be a value in a range of a predetermined amount of change with respect to the frequency at an edge portion of the side where scanning of the image region starts (the start point 1001). In other words, the correction control unit 141 may control the image clock correction unit 142 so that, in the non-image region, the frequency of the image clock 126*b* changes within the range of the predetermined amount of change with respect to the frequency at the start point 1001. This predetermined amount of change can be set as a range that can suppress the influence of response properties of the PLL circuit in the image clock correction unit 142 with respect to frequency control of the image clock 126*b*. In a duration from when the laser beam 208 starts scanning the scanning region of one line until it reaches the start point 1001, the image clock correction unit 142 corrects the frequency of the reference image clock 126*a* so that the frequency of the image clock 126*b* becomes the target frequency at the start point 1001. By such frequency control, it is possible to reduce error produced in frequency control of the image clock 126*b* due to the influence of the response property of the PLL circuit in the image clock correction unit 142. As a result, it is possible to prevent accuracy of a partial magnification correction from being reduced due to such an error.

Second Embodiment

In the second embodiment, frequency control of the image clock 126*b* is performed by a method different to that of the first embodiment in the non-image region from the output timing of the BD signal until the start point 1001 of the image region. Specifically, in the first embodiment the frequency (the reference frequency) of the reference image clock 126*a* used to generate the image clock 126*b* in the image clock control unit 127 is set in accordance with overall magnification (an average value of the magnification in the image region). In contrast to this, in the present embodiment the reference frequency is set to the target frequency at the start point 1001 of the image region instead of a frequency set in accordance with overall magnification. Note that, below, explanation regarding portions in common with the first embodiment is omitted, and points of difference with the first embodiment are mainly explained.

Figure 12A:
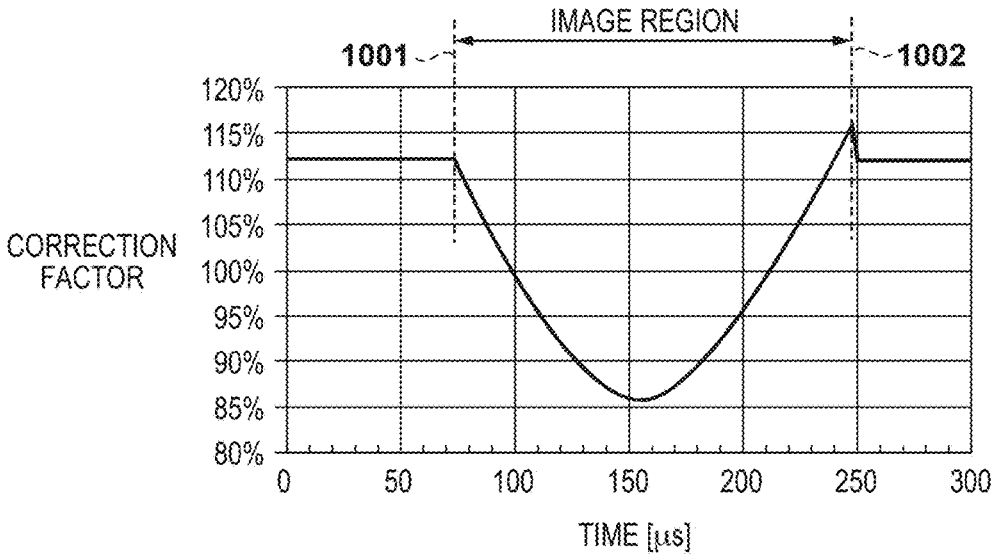
FIGS. 12A and 12B illustrate examples of temporal change of a correction factor of the frequency of an image clock.

FIG. 12A illustrates an example of a correction factor applied to the frequency of the image clock 126*b* (RCLK), according to the present embodiment. In the present embodiment, a reference frequency corresponding to the frequency of the image clock 126*b* at the output timing of the BD signal (time 0) is set to the same frequency of the target frequency at the start point 1001 of the image region. By this, the frequency of the image clock 126*b* is controlled to be fixed at the same frequency as the target frequency at the start point 1001 of the image region in the non-image region from the output timing (time 0) of the BD signal until the start point 1001 of the image region, as illustrated in FIG. 10B.

By this, it becomes possible to control (correct) the frequency of the image clock 126*b* to be a frequency that corresponds to a correction factor for appropriately performing a partial magnification correction at the start point 1001 (an edge portion image height) of the image region, without depending on the PLL circuit in the image clock correction unit 142. In other words, similarly to the first embodiment, even if the PLL circuit in the image clock correction unit 142 has a slow response property, it is possible to control the frequency of the image clock 126*b* to be a frequency suitable for a partial magnification correction in the image region.

Note that the reference frequency does not always need to be set to the target frequency at the start point 1001 (an edge portion image height) of the image region, and it may be set to a different value in a range that can suppress the influence of the response property of the PLL circuit in the image clock correction unit 142. For example, it may be set to a frequency that is smaller than the target frequency at the start point 1001 of the image region, and higher than a frequency set in accordance with overall magnification (the average value of the magnification in the image region) that is used in the first embodiment. By this, it is possible to make the amount of change of the frequency of the image clock 126*b* in the non-image region be smaller than in a case where a frequency set in accordance with overall magnification is set to the reference frequency, and control of the frequency of the image clock 126*b* that suppresses the change rate becomes easy.

Third Embodiment

In the third embodiment, frequency control of the image clock 126*b* is performed so that a period in which the frequency of the image clock 126*b* in the non-image region is fixed is made as short as possible. By this, accuracy of partial magnification correction improves, and unnecessary radiation noise arising due to the image clock 126*b* decreases. Note that, below, explanation regarding portions in common with the first and second embodiments is omitted, and points of difference with the first and second embodiments are mainly explained.

Typically, when producing a signal having bandwidth of several tens of MHz such as an image clock, there is a problem that unnecessary radiation noise is generated. One method for reducing such unnecessary radiation noise is to cause a frequency component of the noise in a frequency domain to be dispersed by causing the frequency of the image clock to shift, for example. Unnecessary radiation noise increases as a period in which the frequency of a generated image clock is fixed lengthens. In contrast, unnecessary radiation noise decreases as the change rate of frequency of the image clock increases.

Figure 12B:
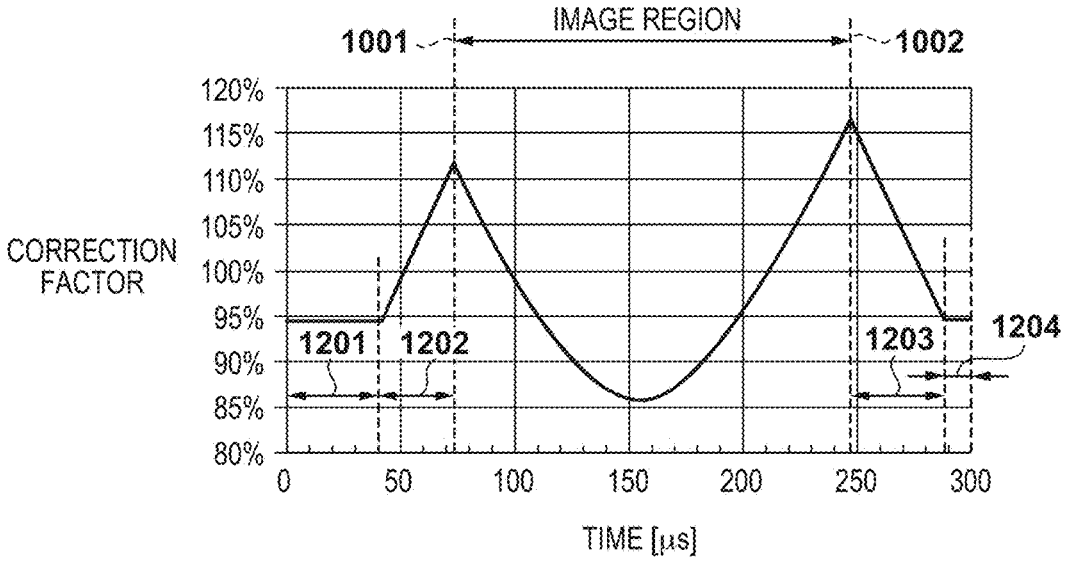

Accordingly, in the present embodiment, frequency control of the image clock 126*b* is performed so that the frequency of the image clock 126*b* changes as much as possible in a range in which degradation of the accuracy of the partial magnification correction due to an error in frequency control of the image clock 126*b* does not occur. FIG. 12B illustrates an example of a correction factor applied to the frequency of the image clock 126*b* (RCLK), according to the present embodiment. As illustrated in FIG. 12B, the correction control unit 141 performs frequency control so that, in the non-image regions, a sum total of periods 1202 and 1203 in which the frequency of the image clock 126*b* changes is longer than a sum total of periods 1201 and 1204 in which the frequency of the image clock 126*b* is constant. By this, for example it is possible to make periods in which the frequency of the image clock 126*b* is constant in the non-image regions be shorter than those in the first embodiment (FIG. 10B), and periods in which the frequency of the image clock 126*b* changes be longer than those in the first embodiment. By this, it is possible to reduce unnecessary radiation noise due to the image clock 126*b*, in comparison to the first embodiment.

In this way, by virtue of the present embodiment, in the image forming apparatus 1, it is possible to prevent the accuracy of partial magnification correction decreasing due to an error that arises in frequency control of the image clock 126*b*, and it is also possible to decrease unnecessary radiation noise.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-131039, filed Jun. 30, 2016, which is hereby incorporated by reference herein in its entirety.

What is claimed is:

1. An image forming apparatus, comprising:

a light source that emits a light beam for exposing a photosensitive member;

a deflection unit that deflects the light beam emitted from the light source such that the light beam scans the photosensitive member;

a generation unit that generates an image clock for controlling timings at which the light source emits light; and a control unit that controls a frequency of the image clock generated by the generation unit according to each position in an image region in which an image is formed in a main scanning direction that is a direction in which the light beam scans a scanning region of one line, wherein the control unit controls the frequency of the image clock in a non-image region that is a region other than the image region, and wherein a change rate of the frequency of the image clock per unit time in the non-image region is smaller than a change rate of the frequency of the image clock per unit time in the image region.

2. The image forming apparatus according to claim 1, wherein the generation unit generates the image clock by correcting a frequency of a reference image clock, and the control unit causes the frequency of the image clock to, in a duration from when the light beam starts scanning of the one line until when the light beam reaches an edge portion of a side where scanning of the image region is started, change by the smaller change rate from a reference frequency that is the frequency of the reference image clock to a target frequency for correcting a partial magnification at the edge portion.

3. The image forming apparatus according to claim 2, wherein the control unit starts controlling the frequency of the image clock from the reference frequency to the target frequency such that, after the light beam has started the scanning of the one line, the frequency of the image clock reaches the target frequency by a timing when the light beam reaches the edge portion.

4. The image forming apparatus according to claim 3, wherein the control unit causes the frequency of the image clock to change by a constant change rate that is smaller than the change rate in the image region, in a duration from when control of the frequency of the image clock from the reference frequency to the target frequency is started until when the frequency of the image clock reaches the target frequency.

5. The image forming apparatus according to claim 2, wherein the control unit:

in the non-image region, controls the generation unit such that the frequency of the image clock reaches the reference frequency; and in the image region, controls the generation unit such that the image clock is generated by correcting the reference frequency at a correction factor set in association with a partial magnification at each position in the image region.

6. The image forming apparatus according to claim 2, wherein the reference frequency is set in accordance with an average value of partial magnifications at respective positions in the image region.

7. The image forming apparatus according to claim 2, wherein the reference frequency is set to a frequency equal to the target frequency.

8. The image forming apparatus according to claim 2, wherein the reference frequency is set to a frequency lower than the target frequency and higher than a frequency set in accordance with an average value of partial magnifications at respective positions in the image region.

9. An image forming apparatus, comprising:

a light source that emits a light beam for exposing a photosensitive member;

a deflection unit that deflects the light beam emitted from the light source such that the light beam scans the photosensitive member;

a generation unit that generates an image clock for controlling timings at which the light source emits light; and a control unit that controls a frequency of the image clock generated by the generation unit according to each position in an image region in which an image is formed in a main scanning direction that is a direction in which the light beam scans a scanning region of one line, wherein the control unit decides the frequency of the image clock in a non-image region being a region other than the image region, in accordance with the frequency of the image clock in the image region.

10. The image forming apparatus according to claim 9, wherein the control unit sets the frequency of the image clock in the non-image region to a value in a range of a predetermined amount of change with respect to a frequency at an edge portion of a side where scanning of the image region is started.

11. The image forming apparatus according to claim 10, wherein the generation unit generates the image clock by correcting a frequency of a reference image clock, and the control unit causes the generation unit to correct the frequency of the reference image clock such that the frequency of the image clock becomes, in a duration from when the light beam starts scanning of the one line until when the light beam reaches the edge portion, a target frequency for correcting a partial magnification at the edge portion.

12. The image forming apparatus according to claim 1, wherein the control unit controls the frequency of the image clock such that, in the non-image region, a period in which the frequency of the image clock is constant becomes shorter than a period in which the frequency of the image clock changes.

13. The image forming apparatus according to claim 1, further comprising:

an imaging lens that causes the light beam deflected by deflection unit to form an image on a surface of the photosensitive member, wherein the light beam that has passed through the imaging lens scans the photosensitive member by a scanning speed that changes in accordance with a position in the scanning region.

14. The image forming apparatus according to claim 1, further comprising:

the photosensitive member;

a charging unit that charges the photosensitive member; and a development unit that develops an electrostatic latent image formed on the photosensitive member in accordance with exposure by the light beam so as to form on the photosensitive member an image to be transferred to a recording medium.

15. The image forming apparatus according to claim 9, wherein the control unit controls the frequency of the image clock such that, in the non-image region, a period in which the frequency of the image clock is constant becomes shorter than a period in which the frequency of the image clock changes.

16. The image forming apparatus according to claim 9, further comprising:

an imaging lens that causes the light beam deflected by deflection unit to form an image on a surface of the photosensitive member, wherein the light beam that has passed through the imaging lens scans the photosensitive member by a scanning speed that changes in accordance with a position in the scanning region.

17. The image forming apparatus according to claim 9, further comprising:

the photosensitive member;

a charging unit that charges the photosensitive member; and a development unit that develops an electrostatic latent image formed on the photosensitive member in accordance with exposure by the light beam so as to form on the photosensitive member an image to be transferred to a recording medium.

* * * * *